US006978924B1

(12) United States Patent
Graham

(10) Patent No.: US 6,978,924 B1
(45) Date of Patent: Dec. 27, 2005

(54) FOOD CONTAINER APPARATUS

(76) Inventor: Wayne B. Graham, 4475 Golden Foothill Pkwy., El Dorado Hills, CA (US) 95762

( * ) Notice: Subject to any disclaimer, the term of this patent is extended or adjusted under 35 U.S.C. 154(b) by 0 days.

(21) Appl. No.: 10/356,686

(22) Filed: Jan. 30, 2003

Related U.S. Application Data

(60) Provisional application No. 60/353,395, filed on Jan. 31, 2002.

(51) Int. Cl.[7] ..... B65D 5/00

(52) U.S. Cl. ..... 229/114; 229/127; 229/148; 229/131; 229/904

(58) Field of Search ..... 229/116.4, 127, 229/148, 922, 147, 114, 131, 904, 902

(56) References Cited

U.S. PATENT DOCUMENTS

| | | | | |
|---|---|---|---|---|
| 0,619,757 | A | | 2/1899 | Johnstone et al. |
| 1,648,156 | A | * | 11/1927 | Tejada ..... 206/268 |
| 1,998,881 | A | * | 4/1935 | McGovern ..... 229/160.1 |
| 2,270,935 | A | | 1/1942 | Doering |
| 2,992,764 | A | | 7/1961 | Goding |
| 3,650,383 | A | | 3/1972 | Nigro |
| 4,189,054 | A | | 2/1980 | Liu et al. |
| 4,232,816 | A | * | 11/1980 | Johnson et al. ..... 229/114 |
| 4,241,863 | A | * | 12/1980 | Faller ..... 229/120.03 |
| 4,273,249 | A | | 6/1981 | Florian |
| 4,339,068 | A | * | 7/1982 | Brauner ..... 229/113 |
| 4,694,987 | A | * | 9/1987 | Forbes, Jr. ..... 229/114 |
| 5,181,649 | A | | 1/1993 | Frost |
| 5,183,202 | A | * | 2/1993 | Love ..... 229/123 |
| 5,205,476 | A | | 4/1993 | Sorenson |
| 5,632,379 | A | | 5/1997 | Frost |

* cited by examiner

*Primary Examiner*—Tri M. Mai
(74) *Attorney, Agent, or Firm*—Strasburger & Price, LLP; Alan R. Thiele

(57) ABSTRACT

A stackable food container includes a lower food receptacle portion, and an upper tray forming section with one or more sides foldably coupled to the lower food receptacle portion. The upper tray forming section encloses the contents of the food container when the one or more sides are in a closed state. The upper tray forming section is configured to cooperatively deploy into a tray when the one or more sides are in an open state. The tray may include an upward-facing rim substantially surrounding the contents of the food container.

6 Claims, 4 Drawing Sheets

FOOD CONTAINER APPARATUS

CROSS REFERENCE TO RELATED APPLICATIONS

This application claims the benefit of U.S. Provisional Application Ser. No. 60/353,395, filed Jan. 31, 2002.

BACKGROUND

Field of the Invention

This disclosed apparatus pertains generally to food containers and methods of use thereof, and more particularly to a disposable food container usable in a fast food or "take-out" environment which provides quick and easy access to food within the container and which prevents spillage of food onto users of the food container.

The Prior Art

Background

Modern society, while conferring many advantages on its members, has introduced complexities which have eroded away at the amount of free time available to many individuals. As a result, various aspects of society have adapted by implementing time-saving measures and procedures. One of the most ubiquitous time-saving adaptations by modern society is that known generally as "fast-food" wherein individuals can quickly purchase and eat food items without the delay associated with preparing the food themselves or ordering food at a more traditional restaurant which would require a substantial wait while food is prepared.

The "fast food" industry has given rise to numerous types of inexpensive, disposable food containers for various types of food products. Such food containers include boxes, bags, cartons, trays of various structures and configurations according to the food items to be contained. The food containers are typically made from paper, card board, polystyrene or other inexpensive material.

A particularly important aspect of the fast food industry is the "drive-through" window, which allows automobile drivers and passengers to purchase food without leaving the automobile, and to eat food while traveling in the automobile.

Currently available food containers have proved deficient in some important respects. Containers typically do not provide protection to the user against drippage or spillage of food. Persons eating food while in an automobile, or who are otherwise simultaneously engaged in other activities while eating, are particularly prone to drippage or spillage. Currently available food containers do not provide adequate protection against spillage, and the resulting grease spots and stains on clothing from such spillage is often a source of irritation and embarrassment for users of fast food.

BRIEF DESCRIPTION OF THE DRAWING FIGURES

DETAILED DESCRIPTION

Figure 1A:
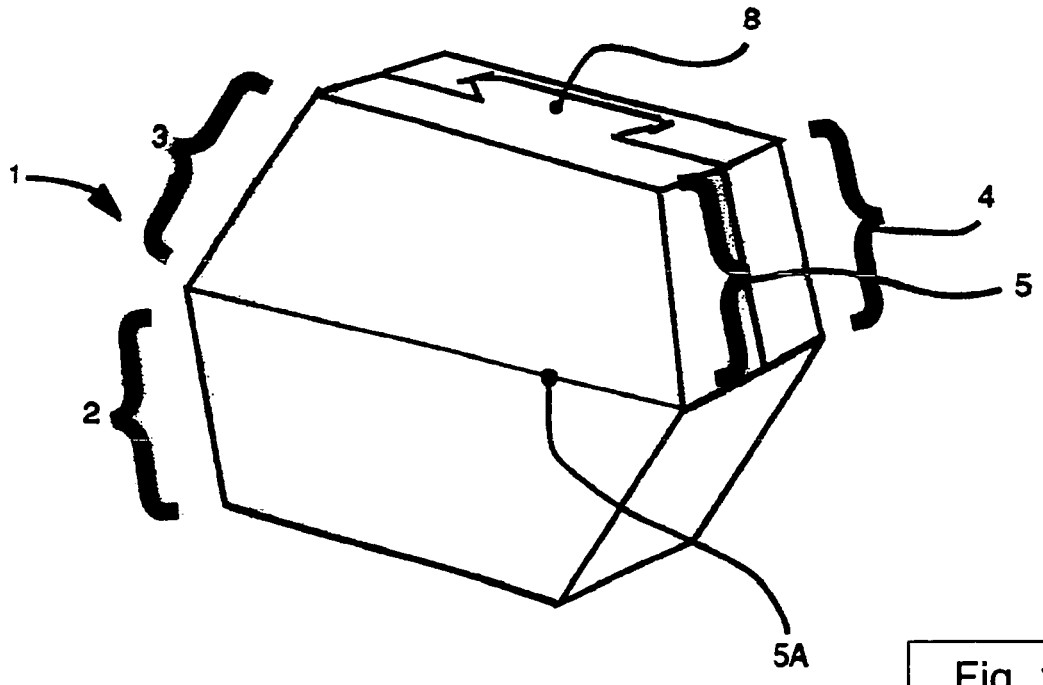
FIGS. 1A–1B are perspective views of a food container in a closed and open state, respectively.

Persons of ordinary skill in the art will realize that the following description is illustrative only and not in any way limiting. Other modifications and improvements will readily suggest themselves to such skilled persons having the benefit of this disclosure. In the following description, like reference numerals refer to like elements throughout.

Figure 1B:
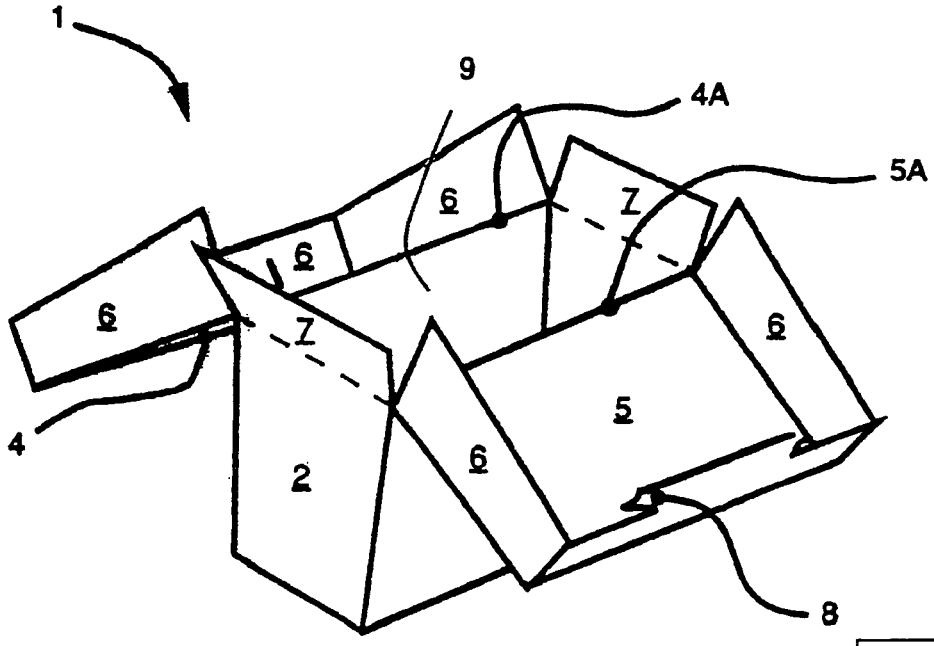

FIGS. 1A and 1B are perspective views of a food container 1 in closed and open states, respectively. The food container 1 includes a lower receptacle portion 2 for receiving a food item. Though the lower receptacle portion 2 is shown in a generally rectangular configuration, it is to be understood that the lower receptacle portion 2 may comprise any shape suitable for receiving a particular food item.

As shown in FIG. 1A, the food container 1 further includes an upper tray forming portion 3 having a pair of opposing sides 4 and 5. As shown in FIG. 1B, each side is foldably coupled to the lower receptacle portion 2 at fold lines 4A and 5A, respectively.

In the closed state shown in FIG. 1A, the opposing sides 4 and 5 preferably seal the contents of the food container 1 and may be secured with a latch 8.

It is contemplated that containers of this disclosure may be made from paper, card board polystyrene or other inexpensive material.

Figure 1C:
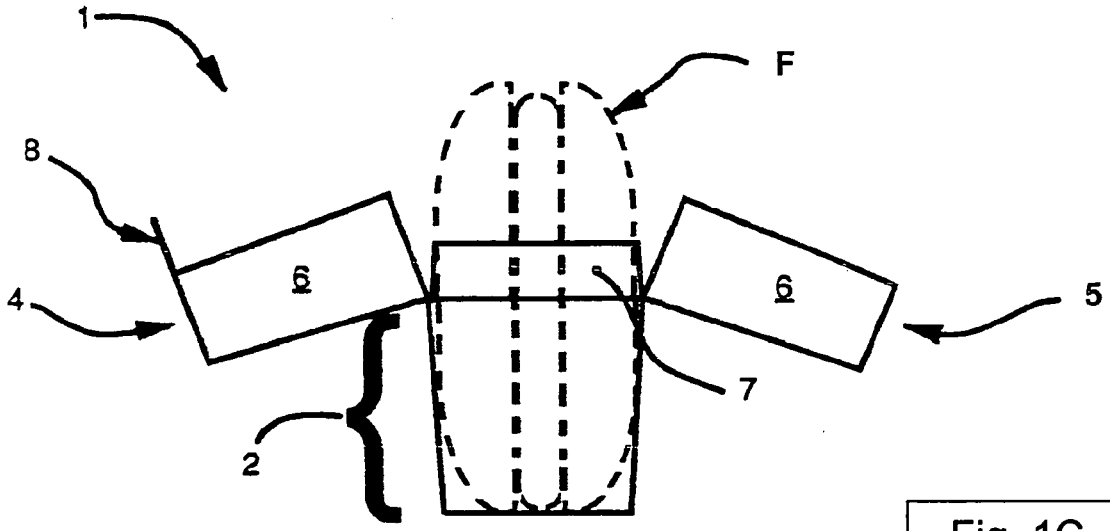
FIG. 1C is an end view of a food container with a food item contained therein.

In FIG. 1B and FIG. 1C, the food container 1 is shown with opposing sides 4 and 5 deployed into an open position. In this open position, a tray is cooperatively formed on either side of the opening 9 by the opposing sides 4 and 5, with the tray having an upward-facing rim 6. In a further embodiment, the rim 6 substantially surrounds any contents retained in the lower receptacle portion 2.

As shown in FIG. 1B, the food container may optionally include a pair of opposing side or end flaps 7, which, in cooperation with the rim 6, may more completely surround the contents of the food container 1.

FIG. 1C is an end view of a food container 1 in an open state having a food item F contained therein. As will be appreciated, the rim 6 will catch and retain any debris that may fall from the food item F, thus preventing the debris from falling onto the user. As is further apparent from FIG. 1C, when the food container 1 is in an open state, the food item F is presented to the user in a manner such that the item may be inspected and eaten, while still being retained in the lower receptacle portion 2.

If the food item F is generally planar in nature, such as the sandwich of FIG. 1C, it will be appreciated that the opposing sides 4 and 5 deploy cooperatively such that a tray is formed that is substantially perpendicular to the planar food item F, and the rim 6 is deployed in an upward-facing manner, towards the user, substantially surrounding the food item F. If the pair of end flaps 7 are present, the food item F will be more completely surrounded.

Figure 2B:
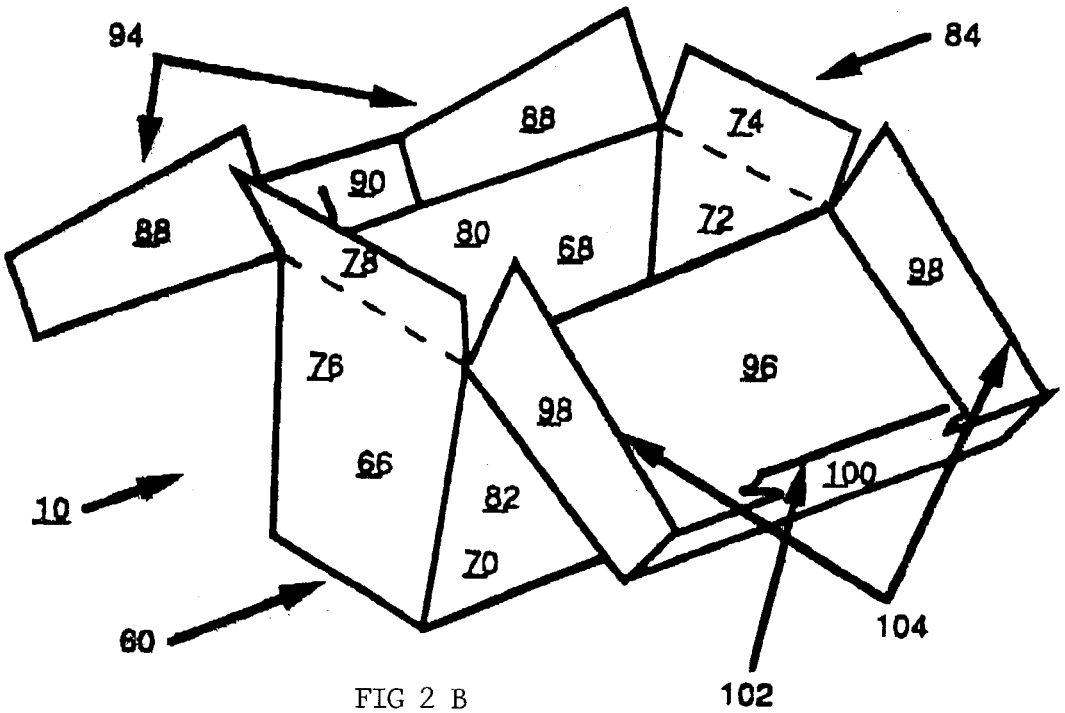
FIGS. 2A–2B are further perspective views of a food container in a closed and open state, respectively.
Figure 2A:
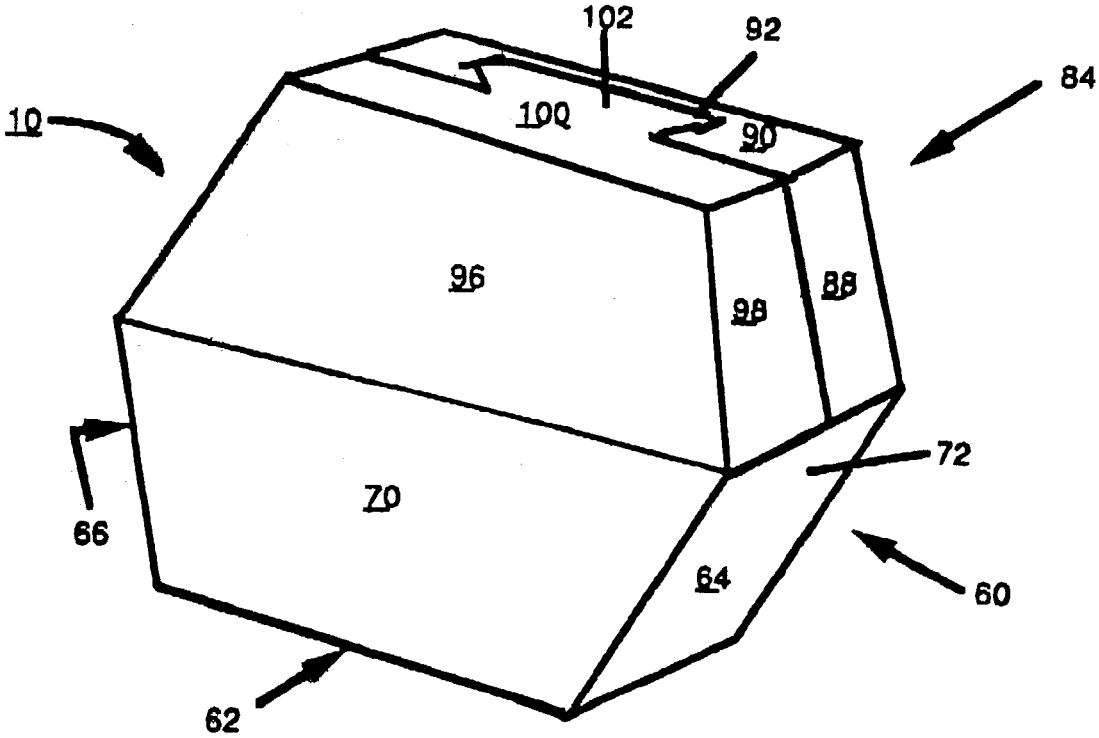

FIGS. 2A and 2B are more detailed disclosures of a food container 10.

Referring generally to both FIGS. 2A and 2B, the food container 10 includes a lower container portion 60 including a bottom panel 62 having opposing first and second ends 64 and 66; and opposing first and second sides 68 and 70 orthogonal to the opposing first and second ends 64 and 66.

The lower container portion 60 may also include a first end panel 72 coupled to the bottom panel 62 proximate to the first end 64 of the bottom panel 62, with the first end panel 72 having a first end flap 74 distal from the first end 64 of the bottom panel 62.

Likewise, the lower container portion 60 may further include a second end panel 76 coupled to the bottom panel 62 proximate to the second end 66 of the bottom panel 62, with the second end panel 76 having a second end flap 78 distal from the second end 66 of the bottom panel 62.

Furthermore, the lower container portion 60 may also include a first lower side panel 80 coupled to the bottom panel 62 at a location proximate to the first side 68 of the bottom panel 62, and a second lower side panel 82 coupled to the bottom panel proximate to the second side 70 of the bottom panel.

The food container 10 may also include an upper container portion 84 including a first upper side panel 86 flexibly coupled to the first lower side panel 68. The first upper side panel 86 may include opposing first and second side panel flaps 88 and a first cover panel 90 coupled to the first upper side panel 86 at a location distal from the first lower side panel 68. The first cover panel 90 may also include a slot 92.

As will be appreciated, the first and second side panel flaps 88 coupled to the first cover panel 90 define a first rim 94 of the upper container portion 84.

The upper container portion 84 may further include a second upper side panel 96 flexibly coupled to the second lower side panel 70. The second upper side panel 96 may also include opposing first and second side panel flaps 98 and a second cover panel 100 coupled to the second upper side panel 96 distal from the second lower side panel 70. The second cover panel 100 may further include a closing tab 102.

As will be appreciated, the first and second side panel flaps 98 being coupled to the second cover panel 100 define a second rim 104 of the upper container portion. Additionally, the first upper side panel 86 and the first rim 94 define a first upper container portion tray 106, and the second upper side panel 96 and the second rim 104 define a second upper container portion tray 108.

Thus, in an open state, the first upper container portion tray 106 and the second upper container portion tray 108, along with the first end tab 74 and the second end tab 78, are configured to form a peripheral food item catch basin. Conversely, in a closed state, the first upper container portion tray 106 and the second upper container portion tray 108 are configured to engagably close and sealably contain a food item within the food container.

Figure 3:
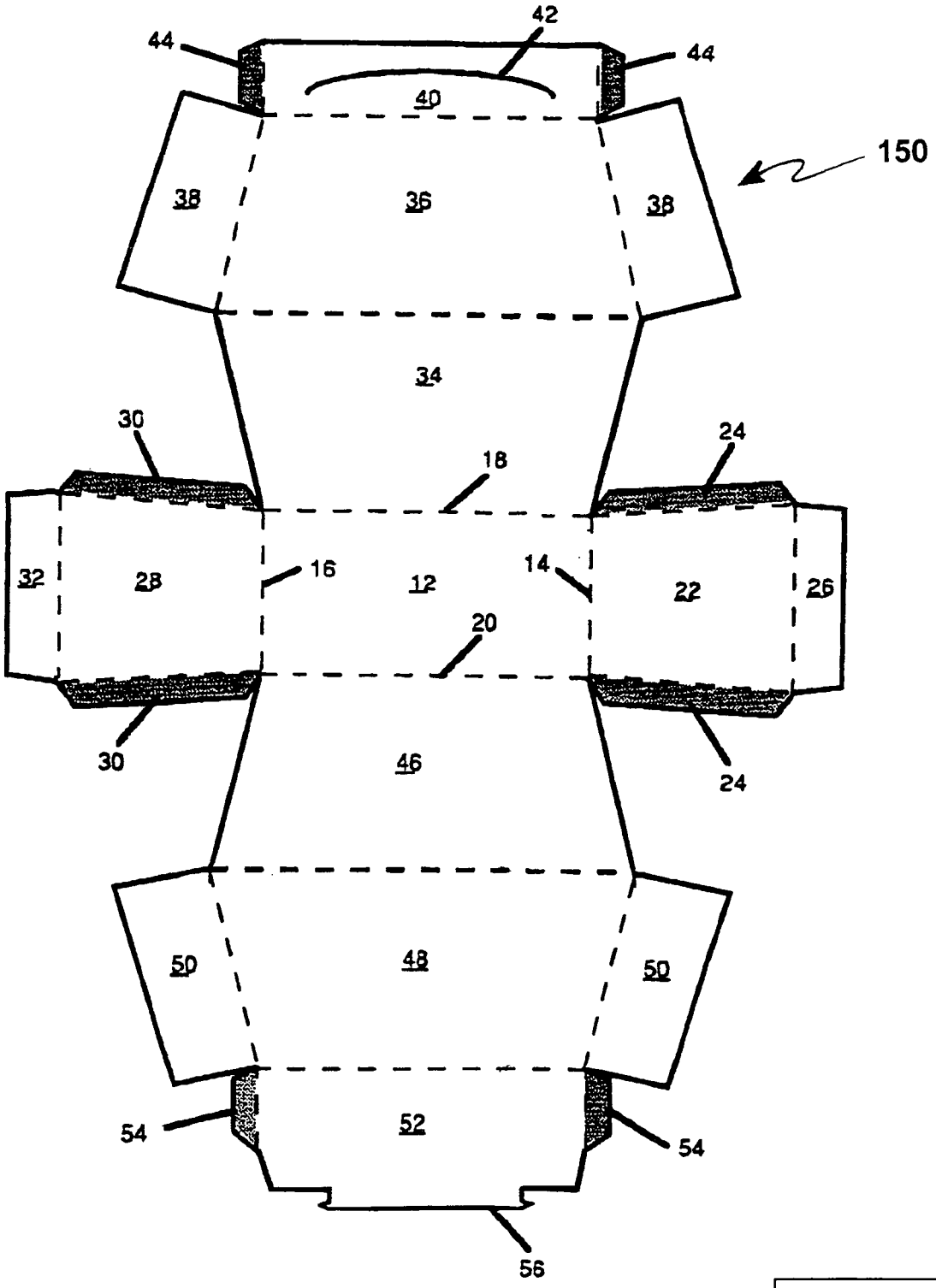
FIG. 3 is a diagram of a sheet configured to be folded and assembled into a food container.

FIG. 3 depicts a food container sheet 150 configured to be folded and assembled into a food container according to the teachings of this disclosure. In a preferred embodiment, the sheet 150 may include a substantially rectangular bottom panel 12 having first and second opposing ends (14, 16) and first and second opposing sides (18, 20).

The sheet 150 may also include a first end panel 22 coupled to the first end 14 of the bottom panel 12 at a fold line. The first end panel 22 may include a pair of opposed side tabs 24 coupled thereto by fold lines, and a first end tab 26 coupled to a distal end thereto by a fold line.

The sheet 150 may also include a second end panel 28 coupled to the second end 16 of the bottom panel 12 at a fold line of the bottom panel 12. The second end panel may include a pair of opposed side tabs 30 coupled thereto by fold lines, and a second end tab 32 coupled to a distal end thereto by a fold line.

The sheet 150 may further include a first lower side panel 34 coupled at a proximate end thereof to the first side 18 of the bottom panel 12 at a fold line, and a first upper side panel 36 coupled to a distal end of the first lower side panel 34. The first upper side panel 36 may include an opposed pair of end flaps 38 coupled thereto by fold lines.

The sheet 150 may also include a first cover top panel 40 coupled to the first upper side panel 36 at a fold line. The first cover top panel 40 may further include a slot 42 formed therein, an opposed pair of cover tabs 44 coupled thereto by fold lines. In a preferred embodiment, the slot 42 may comprise an arc-shaped slot to better facilitate mating with closing tab 56.

The sheet 150 may further include a second lower side panel 46 coupled at a proximate end thereof to the second side 20 of the bottom panel 12 at a fold line, and a second upper side panel 48 coupled to a distal end of the second lower side panel 46, with the second upper side panel 48 including a opposed pair of end flaps 50 coupled thereto by fold lines.

The sheet 150 may further include a second cover panel 52 coupled to the second upper side panel 48 at a fold line, with the second cover panel 52 including an opposed pair of cover tabs 54 coupled thereto by fold lines, and a closing tab 56 coupled to a distal end thereto by a fold line.

Additionally, the first and second lower side panels may be substantially trapezoidal in shape. As such, the trapezoids will each have two parallel edges and two nonparallel edges. The food container of this disclosure may be defined such that the longer of each said two parallel edges share a common fold line. Likewise, the first and second upper side panels may be substantially trapezoidal in shape, having two parallel edges and two nonparallel edges, wherein the longer of each parallel edge share a common fold line.

Figure 1D:
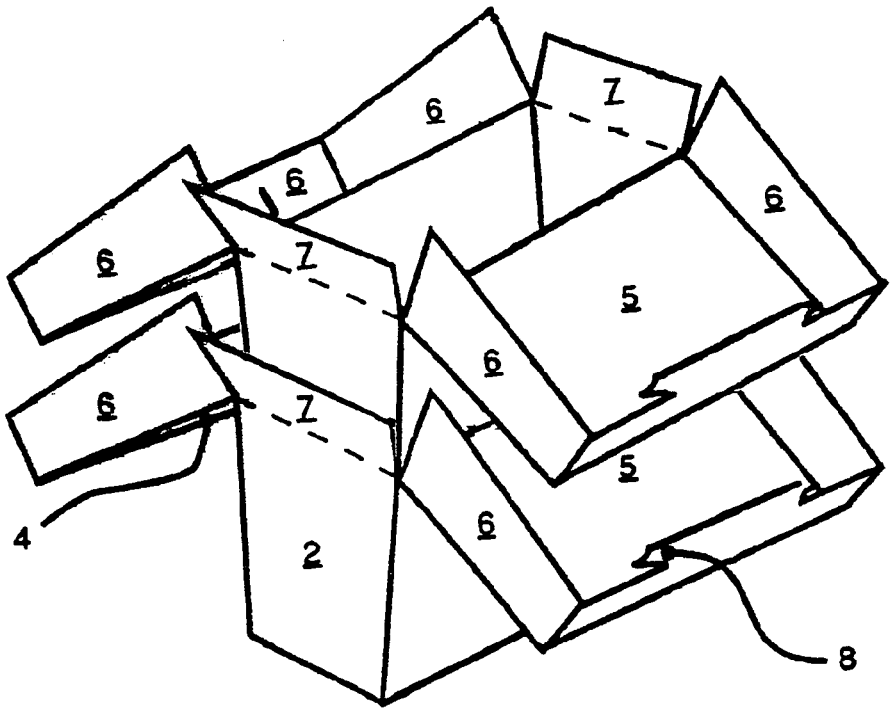
FIG. 1D is a perspective view of stacked food containers.

When the panels of the food container are trapezoidal shaped, the food container may be assembled and stacked as shown in FIG. 1D within each other when the upper tray portion is in the open state.

While multiple embodiments and applications of this disclosure have been shown and described, it is now apparent to those skilled in the art that many more modifications and improvements than mentioned above are possible without departing from the inventive concepts herein. The disclosure, therefore, is not to be restricted except in the spirit of the appended claims.

What is claimed is:

1. A food container comprising:

a lower container portion including a bottom panel having opposing first and second ends and opposing first and second sides orthogonal to said opposing first and second ends;

said lower container portion including a first end panel coupled to said bottom panel proximate to said first end of said bottom panel;

said lower container portion including a second end panel coupled to said bottom panel proximate to said second end of said bottom panel;

said lower container portion including a first lower side panel coupled to said bottom panel proximate to said first side of said bottom panel;

said lower container portion including a second lower side panel coupled to said bottom panel proximate to said second side of said bottom panel;

an upper container portion including a first upper side panel flexibly coupled to said first lower side panel;

said first upper side panel including opposing first and second side panel flaps and a first top panel coupled to said first upper side panel distal from said first lower side panel, said first and second side panel flaps being coupled to said first top panel to define a first rim of said upper container portion;

said upper container portion including a second upper side panel flexibly coupled to said second lower side panel;

said second upper side panel including opposing first and second side panel flaps and a second top panel coupled to said second upper side panel distal from said second lower side panel, said first and second side panel flaps being coupled to said second top panel to define a second rim of said upper container portion;

said first upper side panel and said first rim defining a first upper container portion tray, and said second upper side panel and said second rim defining a second upper container portion tray;

said first upper container portion tray and said second upper container portion tray and a first end tab and a second end tab forming a peripheral food item catch basin in an open state; and said first upper container portion tray and said second upper container portion tray sealably engaging to contain a food item within the food container.

2. The food container as defined in claim 1 wherein:

said first top panel includes a slot; and said second top panel includes a tab engageable with said slot.

3. A sheet for forming a food container comprising:

a substantially rectangular bottom panel, having first and second opposing ends and first and second opposing sides;

a first end panel coupled to said first end of said bottom panel at a fold line of said bottom panel, said first end panel including a pair of opposed side tabs coupled thereto by fold lines, and a first end tab coupled to a distal end thereto by a fold line;

a second end panel coupled to said second end of said bottom panel at a fold line of said bottom panel, said second end panel including a pair of opposed side tabs coupled thereto by fold lines, and a second end tab coupled to a distal end thereto by a fold line;

a first lower side panel coupled at a proximate end thereof to said first side of said bottom panel at a fold line;

a first upper side panel coupled to a distal end of said first lower side panel, said first upper side panel including an opposed pair of end flaps coupled thereto by fold lines;

a first top panel coupled to said first upper side panel at a fold line, said first top panel including a slot formed therein, said first top panel including an opposed pair of cover tabs coupled thereto by fold lines;

a second lower side panel coupled at a proximate end thereof to said second side of said bottom panel at a fold line;

a second upper side panel coupled to a distal end of said second lower side panel, said second upper side panel including an opposed pair of end flaps coupled thereto by fold lines; and a second top panel coupled to said second upper side panel at a fold line, said second top panel including an opposed pair of cover tabs coupled thereto by fold lines, and a closing tab coupled to a distal end thereto by a fold line.

4. The sheet as defined in claim 3 wherein said first and second lower side panels are shaped to facilitate stacking of multiple empty food containers.

5. The sheet as defined in claim 3 wherein said first and second upper side panels are shaped to facilitate stacking of multiple empty food containers.

6. A food container comprising:

a lower container portion including a bottom panel having opposing first and second ends and opposing first and second sides orthogonal to said opposing first and second ends;

said lower container portion including a first end panel coupled to said bottom panel proximate to said first end of said bottom panel, said first end panel having a first end flap distal from said first end of said bottom panel;

said lower container portion including a second end panel coupled to said bottom panel proximate to said second end of said bottom panel, said second end panel having a second end flap distal from said second end of said bottom panel;

said lower container portion including a first lower side panel coupled to said bottom panel proximate to said first side of said bottom panel;

said lower container portion including a second lower side panel coupled to said bottom panel proximate to said second side of said bottom panel;

an upper container portion including a first upper side panel flexibly coupled to said first lower side panel;

said first upper side panel including opposing first and second side panel flaps and a first top panel coupled to said first upper side panel distal from said first lower side panel, said first top panel including a slot; said first and second side panel flaps being coupled to said first top panel to define a first rim of said upper container portion;

said upper container portion including a second upper side panel flexibly coupled to said second lower side panel;

said second upper side panel including opposing first and second side panel flaps and a second top panel coupled to said second upper side panel distal from said second lower side panel, said second top panel including a closing tab; said first and second side panel flaps being coupled to said second top panel to define a second rim of said upper container portion;

said first upper side panel and said first rim defining a first upper container portion tray, and said second upper side panel and said second rim defining a second upper container portion tray;

said first upper container portion tray and said second upper container portion tray and said first end tab and said second end tab forming a peripheral food item catch basin in an open state; and said first upper container portion tray and said second upper container portion tray sealably engaging to contain a food item within the food container.

* * * * *